United States Patent [19]

Basseggio

[11] Patent Number: 4,895,498

[45] Date of Patent: Jan. 23, 1990

[54] CRANK CASE CHAMBER

[76] Inventor: Narcizo O. Basseggio, Av. FChui, 376/401-Cristal CEP 90650 Porte Alegre, R.S., Brazil

[21] Appl. No.: 293,929

[22] Filed: Jan. 5, 1989

Related U.S. Application Data

[62] Division of Ser. No. 44,363, filed as PCT BR86/00009 on Jun. 11, 1986, published as WO86/07415 on Dec. 18, 1986, Pat. No.

[30] Foreign Application Priority Data

Jun. 14, 1985 [BR] Brazil ..... 8502912

[51] Int. Cl.[4] ..... F01M 11/06; F04B 39/02

[52] U.S. Cl. ..... 417/426; 62/510; 184/103.1

[58] Field of Search ..... 417/426 E, 428, 228; 62/510; 184/103.1

[56] References Cited

U.S. PATENT DOCUMENTS

| | | | |
|---|---|---|---|
| 2,233,168 | 2/1941 | Johnson | 42/153 |
| 2,246,244 | 6/1941 | Consley | 417/521 |
| 2,253,623 | 8/1941 | Jordan | 417/338 |
| 2,294,552 | 9/1942 | Gygax | 184/103.1 |
| 2,869,775 | 1/1959 | Neubauer | 417/338 |
| 3,009,632 | 11/1961 | Berger et al. | 417/338 |
| 3,140,041 | 7/1964 | Kramer et al. | 417/338 |
| 3,237,852 | 3/1966 | Shaw | 417/338 |
| 3,243,101 | 3/1966 | Shaw | 417/338 |
| 3,581,519 | 6/1971 | Garrett et al. | 417/228 |
| 3,719,057 | 3/1973 | Grant | 62/510 |
| 4,179,248 | 12/1979 | Shaw | 417/428 |
| 4,505,650 | 3/1985 | Hannett et al. | 417/426 |

FOREIGN PATENT DOCUMENTS

| | | | |
|---|---|---|---|
| 0064018 | 4/1982 | European Pat. Off. . | |
| 0149366 | 1/1984 | European Pat. Off. . | |
| 131885 | 8/1982 | Japan | 417/338 |

*Primary Examiner*—Leonard E. Smith

*Attorney, Agent, or Firm*—Arnold, White & Durkee

[57] ABSTRACT

A system of parallel compressors for compressing fluids miscible with oil. Means are provided for internally separating each compressor connected in parallel into a discharge chamber, a suction chamber, and a crankcase chamber, the chambers of each compressor being independent of one another. The crankcase chambers are connected in oil and gas flow communication with one another. A suction manifold is connected to the suction chambers, and each crankcase chamber is equalized with suction pressure. A discharge manifold is connected to the discharge chambers. Means for separating the oil from compressed fluids leaving the discharge chambers and returning the oil so separated to the crankcase chambers are also provided.

11 Claims, 3 Drawing Sheets

CRANK CASE CHAMBER

This is a divisional of application Serial No. 044,363, filed as PCT BR86/00009 on Jun. 11, 1986, published as WO86/07415 on Dec. 18, 1986, now U.S. Pat. No. 4,822,259.

This invention relates to levelling the oil of compressors and/or compression machines for fluids (vapor or gas) which are connected in parallel in the same circuit.

It relates to a device which may be used in the Industrial Engineering area, for levelling the crankcase oil, when two or more compression machines for gas or vapor are connected in parallel, in the same circuit.

The system provided by the present invention may be specifically used for air conditioning and refrigeration, or more generally to compressed air and simple processes for mechanical compression of vapor and gas.

The compressors used in the present invention may be, for example, piston (reciprocal), centrifugal, blade, or screw type machines of volumetric displacement, which function to reduce the specific volume of a fluid in the physical state of vapor or gas.

BRIEF DESCRIPTION OF THE DRAWINGS

FIG. 1 shows a conventional compressor having two pressure chambers: a high pressure or discharge (1) and a low pressure or suction (2).

Figure 1:
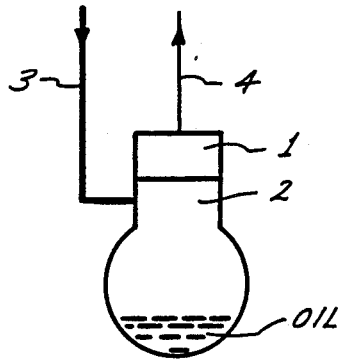
FIG. 1 PRIOR ART
FIG. 1 is a schematic of a conventional compressor.

The crankcase of the conventional compressor of FIG. 1 is generally operated at suction pressure.

Present techniques of levelling the crankcase oil in compression units, when connected in parallel in the same circuit include use of two pressure equalization connections.

Figure 2:
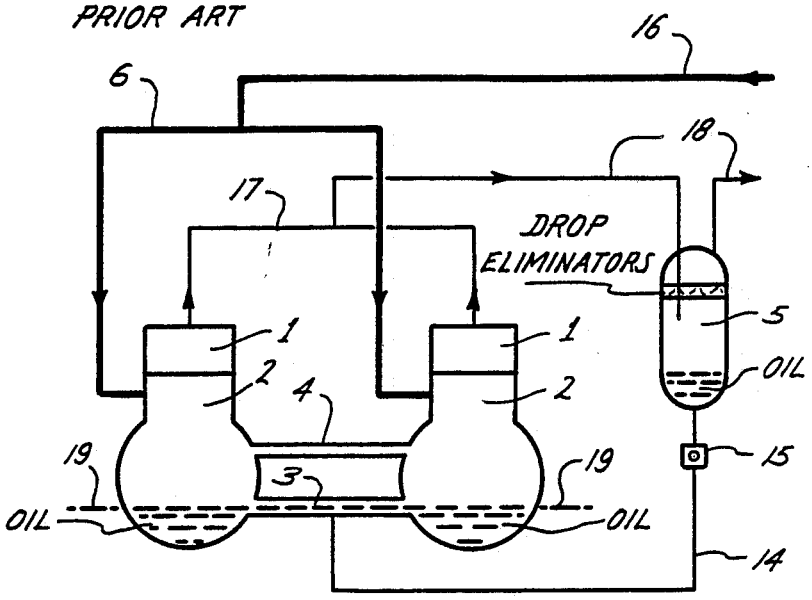
FIG. 2 PRIOR ART
FIG. 2 is a schematic of two conventional compressors connected in parallel.

Referring to FIG. 2, the connection whose axis passes by the oil level (19) line is called OIL EQUALIZATION (3). The connection over the oil level line (19) is called GAS EQUALIZATION (4).

This technique recommends the use of identical compression units, i.e., with the same volumetric displacement, and the same rotation with suction and discharge intakes, with equal pressure losses.

Reaching such recommendation is based on obtaining identical volumetric efficiency, which is difficult in practice due to:

(1) having unequal mechanical wear in different machines, propitiated by different operating times;

the difficulty in obtaining the same rotation for all the compressors, caused by little differences of velocity at the electrical motors or by different friction forces of the movement transmission belts.

In view of these differences, one of the machines connected in parallel will have a pressure lower than the other, thus causing vapor or gas flow through the equalization pipes from the machine of higher pressure to the one of lower pressure.

In the compression units, oil can be returned by means of an OIL SEPARATOR (5) placed in the collective or individual discharge of the compressors and also by means of a SUCTION MANIFOLD (6) in systems having fluids in which the lubricating oil is miscible.

Considering these assumptions, the oil flow will prefer the return to the compressor of lower suction pressure, following the internal flow of the gas by the oil equalization pipe (3).

When this tendency has been maintained during a relatively long operating time, the oil level considerably increases in the compressor of lowest pressure and, therefore, there is a drawdown of the oil level of the other compressors. This subjects the machine of lowest pressure to the risk of overflowing of "liquid hammers", while subjecting the others to the risk of the lack of lubrication, due to the absence of oil.

In the case of machines with individual control of capacity i.e., which operate at partial charge, the above situation is even more critical, considering the big pressure difference created by the unequal volumetric displacements.

The same occurs with parallel compression units of different models.

In the last two cases, present techniques include use of individual oil level controls for each crankcase, avoiding the oil (3) and gas (4) equalization, shown in FIG. 2.

The present state of the described technique is described by the following bibliography:

1. ASHARE HANDBOOK—1984 SYSTEMS, pg. 24:16 American Society of Heating Refrigerating And Air Conditioning Engineers, Inc; Atlanta, U.S.A., 1984;

2. CARRIER, Handbook of Air Conditioning Systems Design pg. 3-65; McGraw-Hill, Inc.; 1960;

3. COSTA-ENNIO CRUZ DA—Refrigeracao—pg. 162; Editora Edgard Blucher Ltda; Sao Paulo; Brazil, 1982;

4. DOSSAT-ROY—Principles de Refrigeracion; pg. 661; Compania Editorial Continental S.A; Spain, 1963;

5. TRANE—Air Conditioning Manual; pg. 176; THE TRANE COMPANY; LA CROSSE, Wisconsin, 1979.

DESCRIPTION OF THE INVENTION

Description of the invention—The invention has the purpose of equalizing and levelling oil reliably and definitively, using a third pressure chamber, or crankcase chamber.

Figure 3:
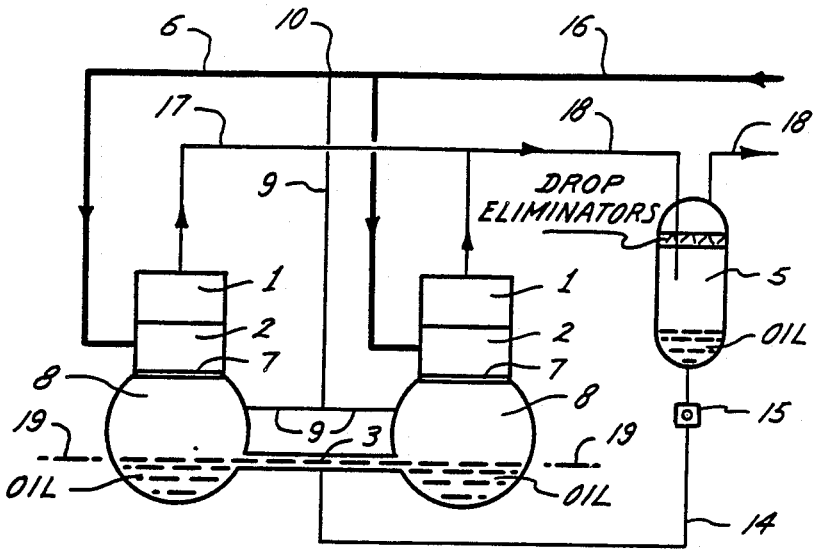
FIG. 3 is a schematic of the preferred embodiment of a system of compressors connected in parallel in accordance with the present invention.

Referring to FIG. 3 one can see the separation (7) between crankcase chamber (8) and suction chamber (2).

This third chamber (8) is created by means of a "dividing cover" (7) forming the "suction chamber" (2) and the "crankcase chamber" (8).

The "dividing cover" (7) tends to prevent the "crankcase chamber" (8) from suffering the influence of the fluid flow which enters the suction chamber (2) and leaves through a discharge chamber (1).

The "crankcase chamber" (8) has the special purpose of storing the lubricating oil, so it must have volumetric capacity bigger than the oil volume it contains, allowing the free oscillation of the oil level.

The "crankcase chamber" (8) operates with suction (i.e. low) pressure. In order to have practically the same suction pressure at the "crankcase chamber" (8) the same is connected, by means of a "capillary tube of gas equalization" (9) in the same point of a "suction general manifold" (10) as shown in FIG. 3.

In the embodiment shown in FIG. 3, it is important that the pressure intake of the suction manifold (6) will be always made at the same point (10), and carried to all the compressors by means of the capillary tube (9).

An oil equalization tube (3), in this case, will allow pressure in the "crankcase chambers" (8) to be equalized and, therefore, the gravity forces will freely operate. Thus, vapor or gas flow between the crankcases is minimized and would occur only during eventual escapes.

Therefore, in any compressor operating from 0% to 100% of its capacity, a considerable flow of vapor or gas will not be allowed between the "crankcase chambers" (8) by the oil equalization tube (3).

Figure 4:
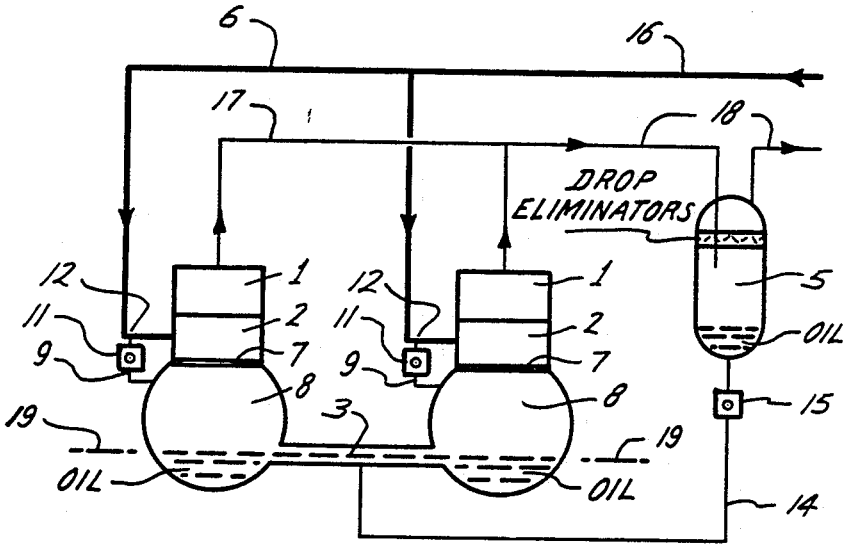
FIG. 4 is a schematic of another embodiment of a system in accordance with the present invention.

FIG. 4 shows another embodiment. The crankcase pressure is equalized with the suction pressure by means of a capillary tube (9), which is interrupted by a little calibrating hole (11). According to this embodiment, the capillary tube (9) is connected in the suction intake (12) of the compressor.

Different compressors, operating with different volumetric displacements create different pressures at the suction chamber intake (12). consequently, this pressure difference causes vapor or gas displacement through the oil equalization tube (3). The calibrating hole (11) is used for damping or reducing the flow between the "crankcase chambers" (8) through the oil equalization tube (3).

Figure 5:
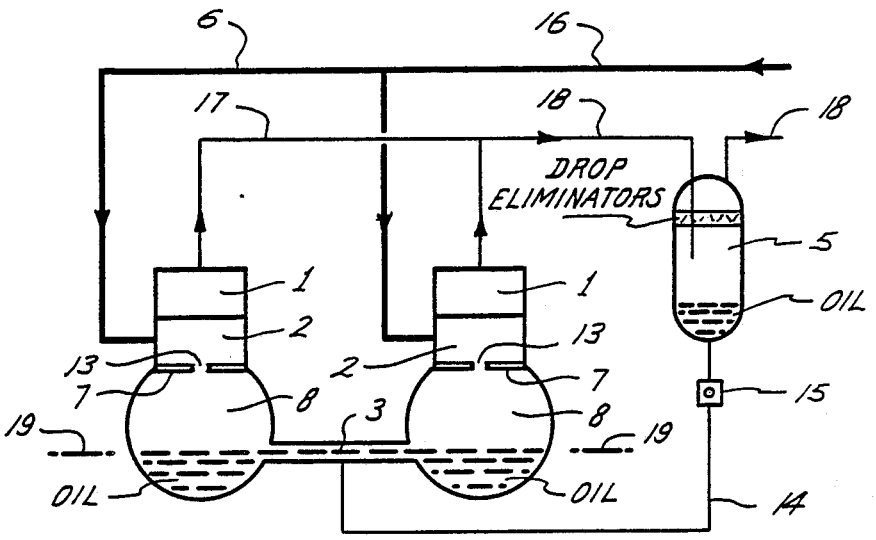
FIG. 5 is a schematic of yet another embodiment of a system in accordance with the present invention.

FIG. 5 shows another embodiment, being similar to the one of FIG. 4, but because of constructive conveniences, a calibrating hole (13) may be provided internally in the "dividing cover" (7), equalizing the "suction chamber" (2) pressure with that of the "crankcase chamber" (8). The only EXTERNAL connection among the compressors in this embodiment is the oil equalization tube (3).

In the three embodiments, the gas flow between the "crankcase chambers" (8) of the compressors is very little so as the gravity forces operate freely on the oil surface.

The "crankcase chamber" (8) operates independently from the "suction chamber" (2). This fact allows use of an "OIL SEPARATOR" (5) of conventional characteristics.

The inventor considers important, in the three embodiments, that a capillary tube for oil return (14), (which connects the oil separator to the crankcases) will be equipped with a calibrating hole (15) in order to minimize turbulences in the "crankcase chambers" (8).

For executing this method, the technician must create a third chamber, i.e., the "crankcase chamber" (8) independent from the suction chamber (2) and discharge chamber (1) as shown in FIG. 3.

The technician will construct a "dividing cover" (7), or a wall casted on the same body, which will be placed in the suction chamber (2), for physically separating the suction chambers (2) and the "crankcase chamber" (8). The "crankcase chamber" (8) has the purpose of storing the lubricating oil, so it must have volumetric capacity bigger than the volume of the oil it contains, allowing the oil to freely oscillate in its level.

In the three embodiments, after constructing the "dividing cover" (7), the technician shall set up the oil equalization tube (3).

For this purpose, the crankcases are connected by means of a horizontal tube, with the axis passing by the desired oil level plane, preferably providing 50% of the section submersed into the oil, and 50% free, as shown in FIG. 3.

In the embodiment shown in FIGS. 3, the capillary tube (9) is connected to the "crankcase chambers" (8) over the oil level, and to the same point (10) on the suction manifold (6).

In the embodiment shown in FIG. 4, an individual capillary tube (9) is provided for each compressor; it is connected to the "crankcase chamber" (8) over the oil level, and to the suction intake (12) of its compressor. The capillary tube (9) shall be interrupted by a little calibrating hold (11).

In the embodiment shown in FIG. 5, the method is similar to the one shown in FIG. 4, differing only in that the calibrating hole (13) is internally set up in the "dividing cover" (7), equalizing the "suction chamber" (2) pressure with that of the "crankcase chamber" (8).

For better understanding and reading of FIGS. 3, 4 and 5 referred to above, the inventor will specify the parts identification as follows:

FIG. 1

1—Discharge chamber
2—Suction chamber
3—Suction line
4—Discharge line

FIG. 2:

1—Discharge chamber
2—Suction chamber
3—Oil equalization tube
4—Gas equalization tube
5—Oil separator
6—Suction manifold
14—Capillary tube for oil return
15—Calibrating hole for oil return
16—Suction general line
17—Discharge manifold
18—Discharge general line
19—Oil level plane

FIG. 3:

1—Discharge chamber
2—Suction chamber
3—Oil equalization tube
4—Gas equalization tube
5—Oil separator
6—Suction manifold
7—Dividing cover of the crankcase and suction chambers
8—Crankcase chamber
9—Capillary tube for gas equalization
10—Point of the suction general manifold
14—Capillary tube for oil return
15—Calibrating hole for oil return
16—Suction general line
17—Discharge manifold
18—Discharge general line
19—Oil level plane

FIG. 4

1—Discharge chamber
2—Suction chamber
3—Oil equalization tube
4—Gas equalization tube
5—Oil separator
6—Suction manifold
7—Dividing cover of the crankcase and suction chambers
8—Crankcase chamber 9—Capillary tube for gas equalization
11—External calibrating hole
12—Suction intake of the compressor
14—Capillary tube for oil return
15—Calibrating hole for oil return
16—Suction general line
17—Discharge manifold
18—Discharge general line
19—Oil level plane

FIG. 5

1—Discharge chamber
2—Suction chamber
3—Oil equalization tube
4—Gas equalization tube
5—Oil separator
6—Suction manifold
7—Manifold cover of the crankcase and suction chambers
8—Crankcase chamber
13—Internal calibrating hole
14—Capillary tube for oil return
15—Calibrating hole for oil return
16—Suction general line
17—Discharge manifold
18—Discharge general line
19—Oil level plane

I claim:

1. A system of parallel compressors for compressing fluids miscible with oil, comprising:

a plurality of compressors connected in parallel;

means for internally separating each compressor into a discharge chamber, a suction chamber, and a crankcase chamber, the chambers of each compressor being independent of one another;

one or more horizontal tubes connected between the crankcase chambers and positioned at a level such that oil occupies a lower portion of each tube and gas occupies the remaining portion of each tube;

a suction manifold connected to the suction chambers;

a capillary tube connecting each crankcase chamber in gas flow communication with the suction manifold, the capillary tube including a calibrating hole;

a discharge manifold connected to the discharge chambers;

means connected to the discharge manifold for separating oil from compressed fluids leaving the discharge chambers; and a conduit connecting the oil separating means to at least one of the horizontal tubes for returning oil to the crankcase chambers, the conduit including a calibrating hole.

2. A system of parallel compressors for compressing fluids miscible with oil, comprising:

a plurality of compressors connected in parallel;

means for internally separating each compressor into a discharge chamber, a suction chamber, and a crankcase chamber, the chambers of each compressor being independent of one another, the separating means including a dividing cover separating the suction chamber and the crankcase chamber, the dividing cover including a calibrating hole connecting the crankcase chamber in gas flow communication with the suction chamber;

one or more horizontal tubes connected between the crankcase chambers and positioned at a level such that oil occupies a lower portion of each tube and gas occupies the remaining portion of each tube;

a suction manifold connected to the suction chambers;

a discharge manifold connected to the discharge chambers;

means connected to the discharge manifold for separating oil from compressed fluids leaving the discharge chambers; and a conduit connecting the oil separating means to at least one of the horizontal tubes for returning oil to the crankcase chambers, the conduit including a calibrating hole.

3. A system of parallel compressors for compressing fluids miscible with oil, comprising:

a plurality of compressors connected in parallel;

means for internally separating each compressor into a discharge chamber, a suction chamber, and a crankcase chamber, the chambers of each compressor being independent of one another;

conduit means for connecting the crankcase chambers in oil and gas flow communication with one another;

a suction manifold connected to the suction chambers;

means for equalizing the pressure of each crankcase chamber with the pressure of the suction manifold comprising a capillary tube connecting each crankcase chamber in gas flow communication with the suction manifold;

a discharge manifold connected to the discharge chambers;

means connected to the discharge manifold for separating oil from compressed fluids leaving the discharge chambers; and means for returning the oil from the oil separating means to the crankcase chambers.

4. The system of claim 3, wherein each capillary tube includes a calibrating hole.

5. The system of claim 3, wherein the conduit means for connecting the crankcase chambers in oil and gas flow communication with one another comprise one or more horizontal tubes connected between the crankcase chambers and positioned at a level such that oil occupies a lower portion of each tube and gas occupies the remaining portion of each tube.

6. The system of claim 5, wherein the means for returning the oil from the oil separating means to the crankcase chambers comprise a conduit connected to at least one of the horizontal tubes.

7. The system of claim 6, wherein the conduit includes a calibrating hole.

8. A system of parallel compressors for compressing fluids miscible with oil, comprising:

a plurality of compressors connected in parallel;

means for internally separating each compressor into a discharge chamber, a suction chamber, and a crankcase chamber, the chambers of each compressor being independent of one another, the separating means including a dividing cover separating the suction chamber and the crankcase chamber, the dividing cover including a calibrating hole connecting the crankcase chamber in gas flow communication with the suction chamber;

conduit means for connecting the crankcase chambers in oil and gas flow communication with one another;

a suction manifold connected to the suction chambers;

a discharge manifold connected to the discharge chambers;

means connected to the discharge manifold for separating oil from compressed fluids leaving the discharge chambers; and means for returning the oil from the oil separating means to the crankcase chambers.

9. The system of claim 8, wherein the conduit means for connecting the crankcase chambers in oil and gas flow communication with one another comprise one or more horizontal tubes connected between the crankcase chambers and positioned at a level such that oil occupies a lower portion of each tube and gas occupies the remaining portion of each tube.

10. The system of claim 8, wherein the means for returning the oil from the oil separating means to the crankcase chambers comprise a conduit connected to at least one of the horizontal tubes.

11. The system of claim 10, wherein the conduit includes a calibrating hole.

* * * * *